US007147750B1

(12) United States Patent
Prough

(10) Patent No.: US 7,147,750 B1
(45) Date of Patent: Dec. 12, 2006

(54) EXTRACTION WITH COMPACTION AND SPRINGBACK CONSIDERATIONS

(75) Inventor: J. Robert Prough, Glens Falls, NY (US)

(73) Assignee: Andritz Inc., Glens Falls, NY (US)

( * ) Notice: Subject to any disclaimer, the term of this patent is extended or adjusted under 35 U.S.C. 154(b) by 1006 days.

(21) Appl. No.: 09/799,372

(22) Filed: Mar. 5, 2001

Related U.S. Application Data

(60) Provisional application No. 60/191,741, filed on Mar. 24, 2000.

(51) Int. Cl.
*D21C 9/00* (2006.01)

(52) U.S. Cl. ..... 162/55; 162/17; 162/18; 162/237; 162/251

(58) Field of Classification Search ..... 162/19, 162/60, 237, 243, 246, 251; 68/181 R; 422/261, 422/264, 265
See application file for complete search history.

(56) References Cited

U.S. PATENT DOCUMENTS 4,028,171 A * 6/1977 Richter ..... 162/19
4,436,586 A * 3/1984 Elmore ..... 162/19
4,836,893 A * 6/1989 Gloersen ..... 162/237
5,985,096 A * 11/1999 Marcoccia et al. ..... 162/246
6,039,841 A * 3/2000 Hernesniemi ..... 30/495
6,129,816 A * 10/2000 Sheerer et al. ..... 162/17
6,272,710 B1 * 8/2001 Prough ..... 162/251

* cited by examiner

*Primary Examiner*—Eric Hug
(74) *Attorney, Agent, or Firm*—Robert Vanderhye

(57) ABSTRACT

A vessel is constructed with (preferably substantially stationary) screen surfaces which minimize compaction of comminuted cellulosic fibrous material, and allow springback of the material, as it flows downwardly. A slurry of wood chips, sawdust, or pulp is passed downwardly past one or more screen surfaces, which have a number of parts, including at least a first perforated part through which liquid is extracted, and a substantially solid part substantially immediately adjacent and below the first part which has a step out to relieve compaction and allow springback of the material.

6 Claims, 4 Drawing Sheets

EXTRACTION WITH COMPACTION AND SPRINGBACK CONSIDERATIONS

CROSS-REFERENCE TO RELATED APPLICATION

This application is based upon provisional application Ser. No. 60/191,741 filed Mar. 24, 2000, the disclosure of which is hereby incorporated by reference herein.

BACKGROUND AND SUMMARY OF THE INVENTION

In the handling of liquid slurries of compressible particulate material, particularly wood chips, sawdust, or like comminuted cellulosic fibrous material, oftentimes the material slurry is acted upon using a screen. Liquid is withdrawn from the slurry through the screen in a process, in the pulp art, often referred to as "extraction". The withdrawn liquid may be passed to recovery (as in certain digester extractions), or may be reintroduced into the slurry, typically after treatment (e. g. increasing the temperature, removing undesirable materials, adding treatment or dilution liquids, or the like).

When liquid is withdrawn through a screen in cellulose pulp production or treatment, two significant phenomena occur, which are dealt with and utilized according to the invention. The first is compression, and the second "springback".

Compaction toward the screen inherently occurs when liquid is drawn through a bed a compressible material (like comminuted cellulosic fibrous material) using a screen. The impact of the compaction means that the bulk of the extracted liquid will be at the first part of the screen surface in the direction of liquid flow (e. g. the top part of the screen when the slurry is flowing downwardly). The bulk of the friction force exerted on the screen by the flowing material will be at the second part of the screen surface in the direction of liquid flow since little liquid is being withdrawn there, and since the material is compacted at that location.

"Springback" refers to the phenomena that the material in the slurry tends to return to substantially its original permeability and consistency (density) if free to do so. That is, once the compaction forces are relieved, the comminuted cellulosic material will spring back to substantially its original permeability and consistency The above principles are taken into account in the design of an improved diffuser, such as shown in co-pending application Ser. No. 09/306,416 filed May 6, 1999 (in particular FIGS. 13 and 14 thereof), the disclosure of which is hereby incorporated by reference herein. It has now been found, according to the present invention, that these same principles may be used in association with dynamic reactors in the pulp and paper art, such as continuous digesters (e. g. KAMYR digesters), such as shown—for example—in U.S. Pat. Nos. 5,620,562, 5,662,775, and 5,849,151, the disclosures of which are hereby incorporated by reference herein. That is, according to the present invention, there is provided a method and apparatus for restriction the time of extraction as the solids bed (slurry) moves past a screen, and to provide expansion after the screen, particularly when the slurry is flowing downwardly as in a continuous digester. This allows the use of gravity to provide a necessary force to overcome resistance on the screen, and to insure that the discharge from the device does not adversely impact the solids compaction at the screen.

According to a first aspect of the present invention, there is provided a method of treating comminuted cellulosic fibrous material in a liquid slurry, using a (preferably substantially stationary) screen having a screen surface with a plurality of parts, comprising:

(a) causing the slurry to move downwardly past the (e. g. substantially stationary) screen;

(b) withdrawing liquid from the slurry through a first part of the screen surface for a time period sufficient to avoid severe compaction;

(c) relieving the compaction force on the material of the slurry at a second part of the screen surface substantially immediately below the first part so as to encourage springback of the material; and (d) repeating (b) and (c) at least once in following part of the screen surface as the slurry continues to move downwardly.

In the method, wherein (b) and (c) may practiced so that the permeability of the material of the slurry does not increase to greater than about 750 lbs. per ft. squared per foot, and the time for (b) is dependent upon the actual material being treated, and differs, for example, for sawdust, conventional wood chips, etc. In one embodiment of the invention a)–(d) are practiced during continuous digesting of the comminuted cellulosic fibrous material, and the material may be a wide variety of materials, including sawdust, wood chips, bagesse, etc.

Also, (a)–(d) may be practiced at a first vertical position in a continuous treatment vessel, and then are repeated at a second vertical position in the continuous treatment vessel, vertically spaced from the first position. Further, (a)–(d) may be practiced using a screen having the screen surface thereof radially inwardly, or alternatively or in addition outwardly, of the moving slurry, and typically the method further comprises reintroducing the liquid withdrawn in (b) into the moving slurry substantially adjacent to where it was withdrawn, using conventional equipment (which may reheat the withdrawn liquid, and/or add digesting liquid or dilution liquid to it, or otherwise treat it as is conventional).

According to another aspect of the present invention, there is provided a method of continuously digesting comminuted cellulosic fibrous material in a slurry, using a (preferably substantially stationary) screen having a screen surface with a plurality of parts, comprising:

(a) substantially continuously treating the material with a digesting liquid;

(b) substantially continuously causing the slurry to move downwardly past the substantially stationary screen;

(c) substantially continuously withdrawing liquid from the slurry through a first part of the screen surface for a time period sufficient to avoid severe compaction; and (d) substantially continuously relieving the compaction force on the material of the slurry at a second part of the screen surface substantially immediately below the first part so as to encourage springback of the material.

In this aspect of the invention, (c) and (d) may be practiced so that the permeability of the material of the slurry does not increase to greater than about 750 lbs. per ft. squared per foot, and (a)–(d) may be practiced during continuous digesting of the comminuted cellulosic fibrous material.

According to yet another aspect of the present invention, there is provided a substantially upright vessel for treating or producing cellulose pulp, comprising: a vessel wall defining a substantially hollow interior, and having a top and bottom; at least one (preferably substantially stationary) screen having a screen surface with at least first and second parts, the first part above the second part and substantially immediately adjacent thereto; the first part being perforated, allowing the passage of extracted liquid therethrough, and defining a first cross-sectional area pathway for slurry flowing therepast; an extraction conduit operatively connected to the perforated first part; the second part being substantially solid and having a step-out substantially immediately adjacent the first part, so that the second part step-out defines a second cross-sectional area pathway greater than the first pathway; a slurry inlet adjacent the vessel wall top; and a slurry outlet adjacent the vessel wall bottom.

This aspect of the invention preferably further comprising a third perforated part of said screen surface substantially immediately adjacent and below said second part, and a fourth substantially solid part of said screen surface substantially immediately adjacent and below said third part and having a step-out; and optionally a perforated fifth part of said screen surface substantially immediately adjacent and below said fourth part. Typically both said first and third screen parts are operatively connected to said extraction conduit, and the extraction conduit may be passed to a recovery system (e. g. a black liquor handling system), and/or may recirculate withdrawn liquid into the vessel, e. g. after heating thereof, and removing, diluting, or adding to the liquid, as is conventional per se. The screen surface may be at or adjacent said vessel wall, and define a flow path of slurry radially inwardly thereof, and/or interior of the vessel wall and define a flow path radially outwardly thereof. A plurality of vertically space substantially stationary screen surfaces pay be provided in the vessel.

It is the primary object of the present invention to enhance the treatment of comminuted cellulosic fibrous material during continuous digesting, or treatment thereof where the material flows downwardly in a slurry. This and other objects of the invention will become clear from an inspection of the detailed description of the invention, and from the appended claims.

BRIEF DESCRIPTION OF THE DRAWINGS

FIG. 3A is a longitudinal schematic cross-sectional view of part of a conventional continuous digester at an area thereof having one or more stationary screens, while

DETAILED DESCRIPTION OF THE DRAWINGS

Figure 1:
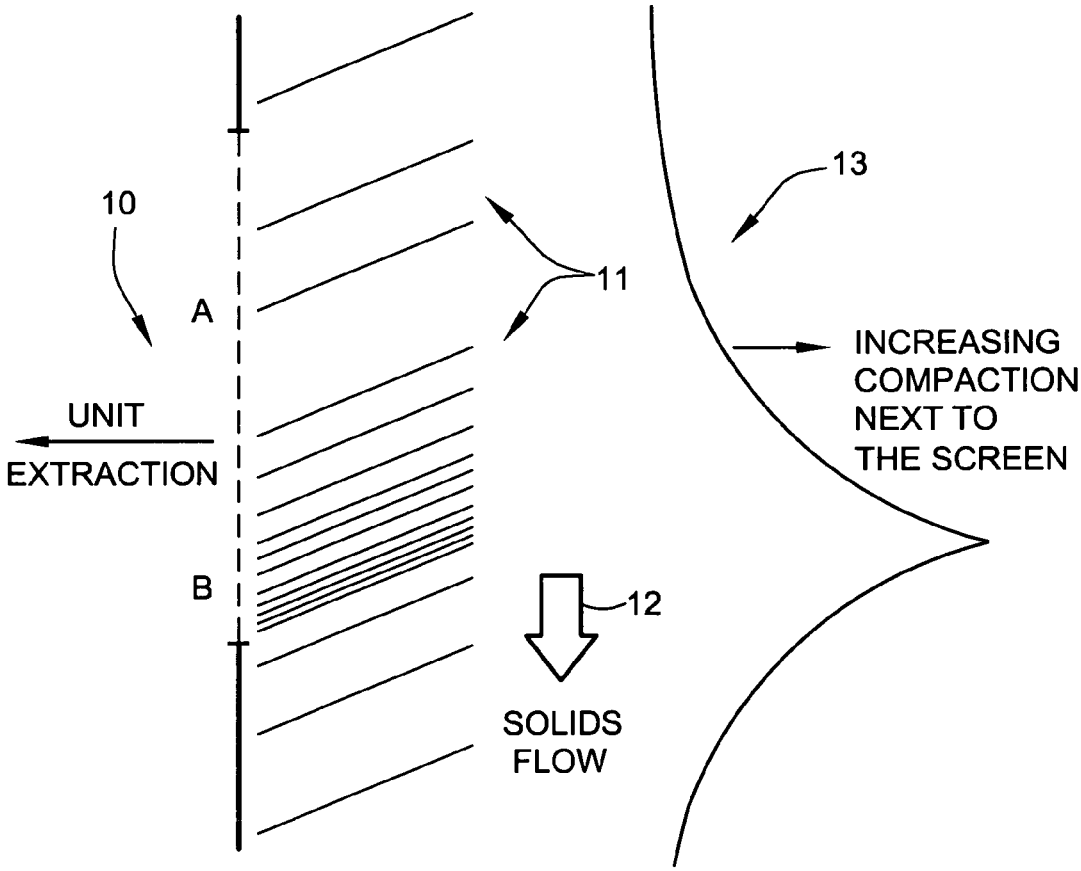
FIG. 1 (PRIOR ART)
FIG. 1 is a diagrammatic view of an exemplary stationary continuous cellulose digester screen and how liquid is extracted therefrom, with a graphical illustration of the compaction of the comminuted cellulosic fibrous material next to the screen surface.

FIG. 1 schematically illustrates a screen surface 10 in a conventional continuous digester which is perforated along its entire length, and schematically shows liquid being extracted therefrom and the amount of compaction (the slanted lines 11) from the top part A of the screen 10 to the bottom part B, the slurry moving downwardly past the screen 10 ass illustrated by arrow 12 in FIG. 1. The graphical illustration 13 at the right of FIG. 1 schematically indicates the increase in compaction from the top to the bottom of the screen 10. As clearly indicated in FIG. 1, undesirably most of the extraction of liquid occurs at the top part A of the screen 10, while the bottom part B merely serves to cause friction with the downwardly moving compacted slurry.

Figure 2:
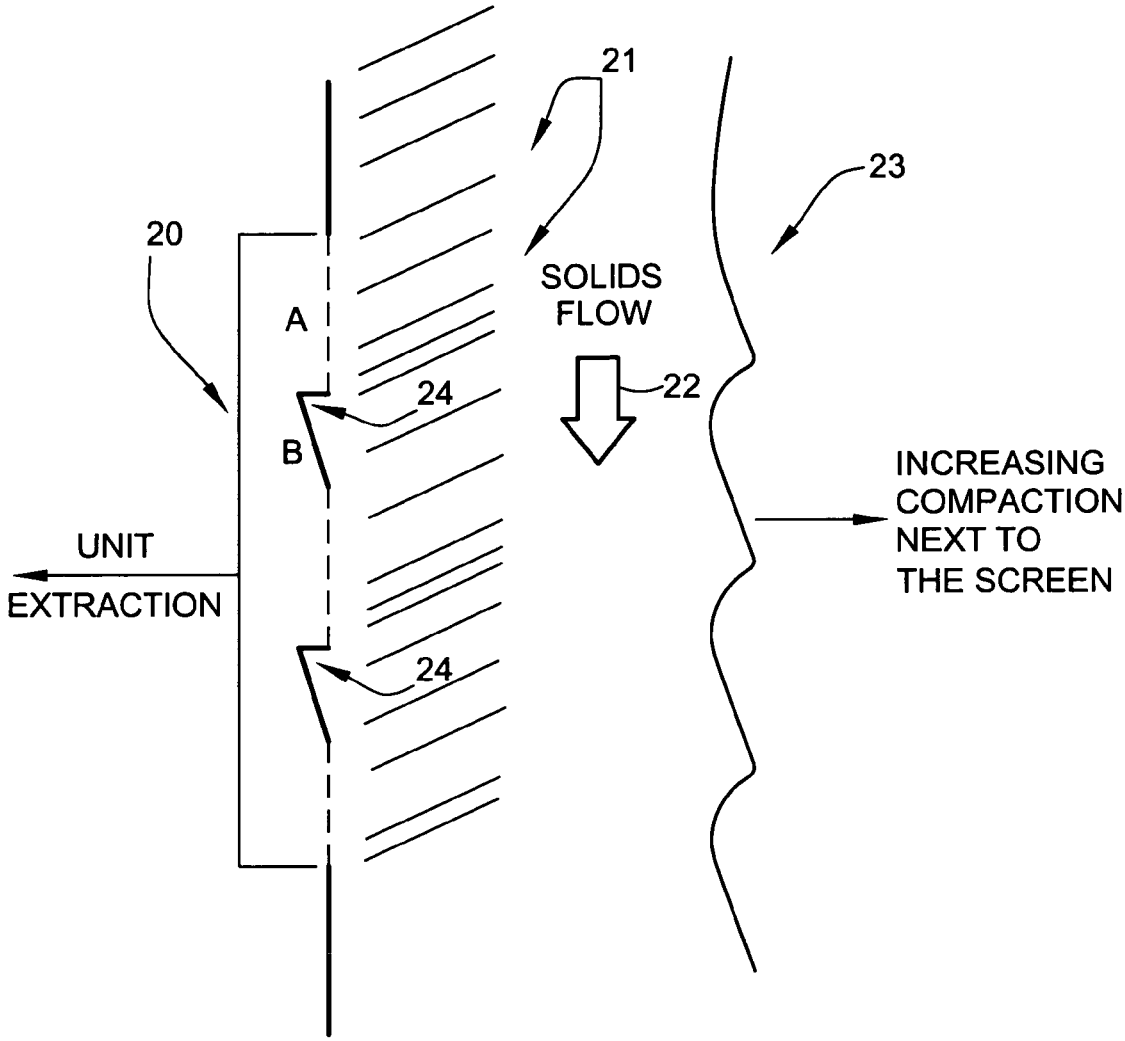
FIG. 2 is a view like that of FIG. 1 only showing a screen, and related graphical illustration, according to one aspect of the present invention.

FIG. 2 is a view like that of FIG. 1 only for an exemplary screen 20 according to the invention. As seen in FIG. 2 by providing the lower part B of the screen 20, substantially immediately adjacent and below the upper part A, as substantially solid, and with a step-out 24, the compaction of the material is relieved, and the material is encouraged to springback to substantially its original permeability and density (consistency). The typical consistency of the material during digesting is between about 8–15%, but the consistency may change depending upon the exact treatment that the material is being subjected to [the invention is not restricted to digestion]. Thus as schematically illustrated in FIG. 2, according to the invention as the slurry flows downwardly as indicated by arrow 22, the lines 21 and graphical illustration 23 indicate less of a compaction problem than in the prior art of FIG. 1.

Figure 3A:
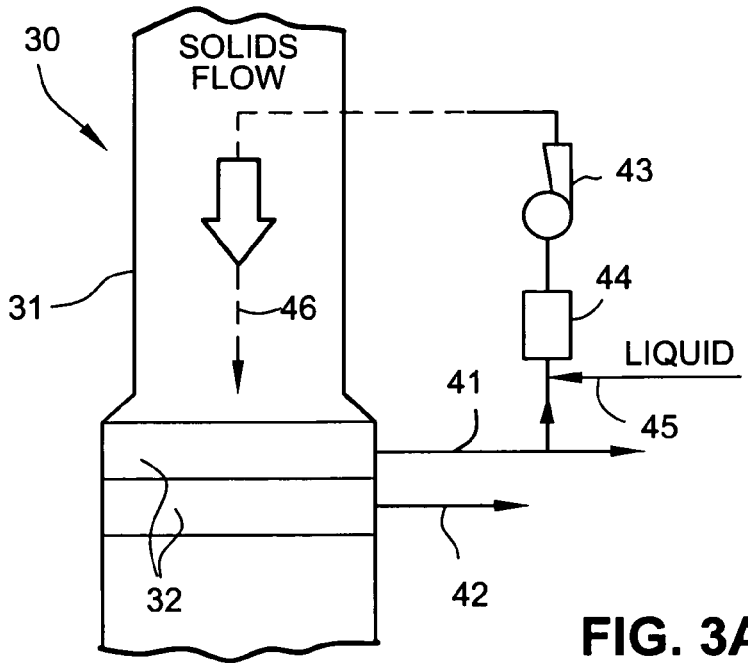

FIG. 3A schematically illustrates a part of a conventional continuous digester 30, which can be modified (with the screen of FIG. 3C) according to the invention. The digester 30 is substantially upright and has a wall 31 with one or more sets of screens 32 stationarily mounted to the wall 31. Only two screens 32 are seen in FIG. 3A, but it is to be understood that a plurality of sets of screens 32 may be disposed at vertically spaced locations along the wall 31, as is conventional.

Figure 3B:
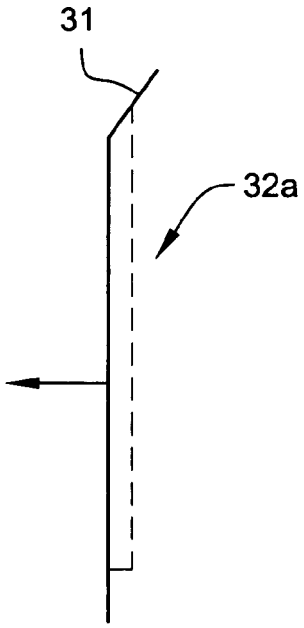
FIG. 3B is a detail view of a conventional screen in the digester of FIG. 3A.
Figure 3C:
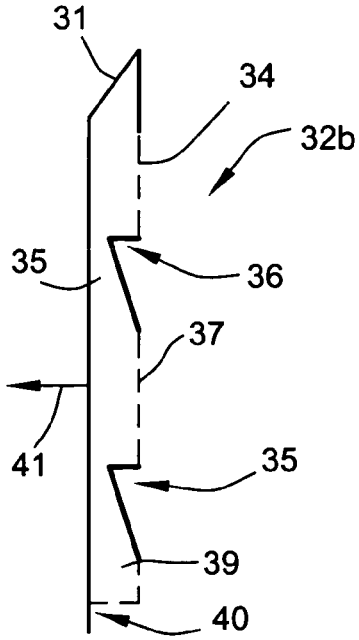
FIG. 3C is a detail view of a screen according to the invention in the digester of FIG. 3A.

FIG. 3B schematically shows the details a conventional screen 32*a* used as one of the screens 32 of FIG. 3A, while FIG. 3C shows a screen 32*b* according to the invention. The screen 32*b* has a first perforated part 34 defining a first cross-sectional area of flow path for the downwardly flowing slurry, a substantially solid second part 35 substantially immediately adjacent and below the first part 34 and having a step-out 36 which relieves compaction, and encourages springback, and third perforated part 37 like the part 34, a fourth part 38 like the part 35, and a fifth perforated part 39 like the part 34, with a step out 40 inherent in the construction of the vessel wall 31 substantially immediately below the fifth part 39.

In FIG. 3C, the lengths of the parts 34, 35, 37, 38, 39, angle of the step-out 36, etc., will depend upon the characteristics of the material in the slurry being treated (e. g. sawdust has different characteristics than conventional softwood chips, etc.), and what the treatment is (e. g. digesting, washing, etc.), and the flow rate through the vessel 30. The purpose of the various lengths of the parts 34, 35, 37–39 (for a given flow rate), etc., will be to minimize compaction of the solids of the slurry, preferably so that the permeability of the particular solids being treated remains substantially at or below about 750 lbs. per foot squared per foot.

As shown schematically in FIG. 3A, the extraction from one or more of the screens 32 can either be passed to recovery, as indicated at 42, and/or recirculated back to the vessel 30 interior after being withdrawn through conduit 41, under the influence of a pump 43, after heating using conventional indirect heater 44, and/or with or without liquid (cooking liquor, dilution liquid, etc.) addition as indicated at 45. The liquid is ultimately recirculated via central pipe 46 back to an area adjacent where the liquid was withdrawn.

As indicated in FIG. 3C, preferably all of the perforated screen parts 34, 37 and 39 are all operatively connected to a single withdrawal conduit 41.

Figure 4:
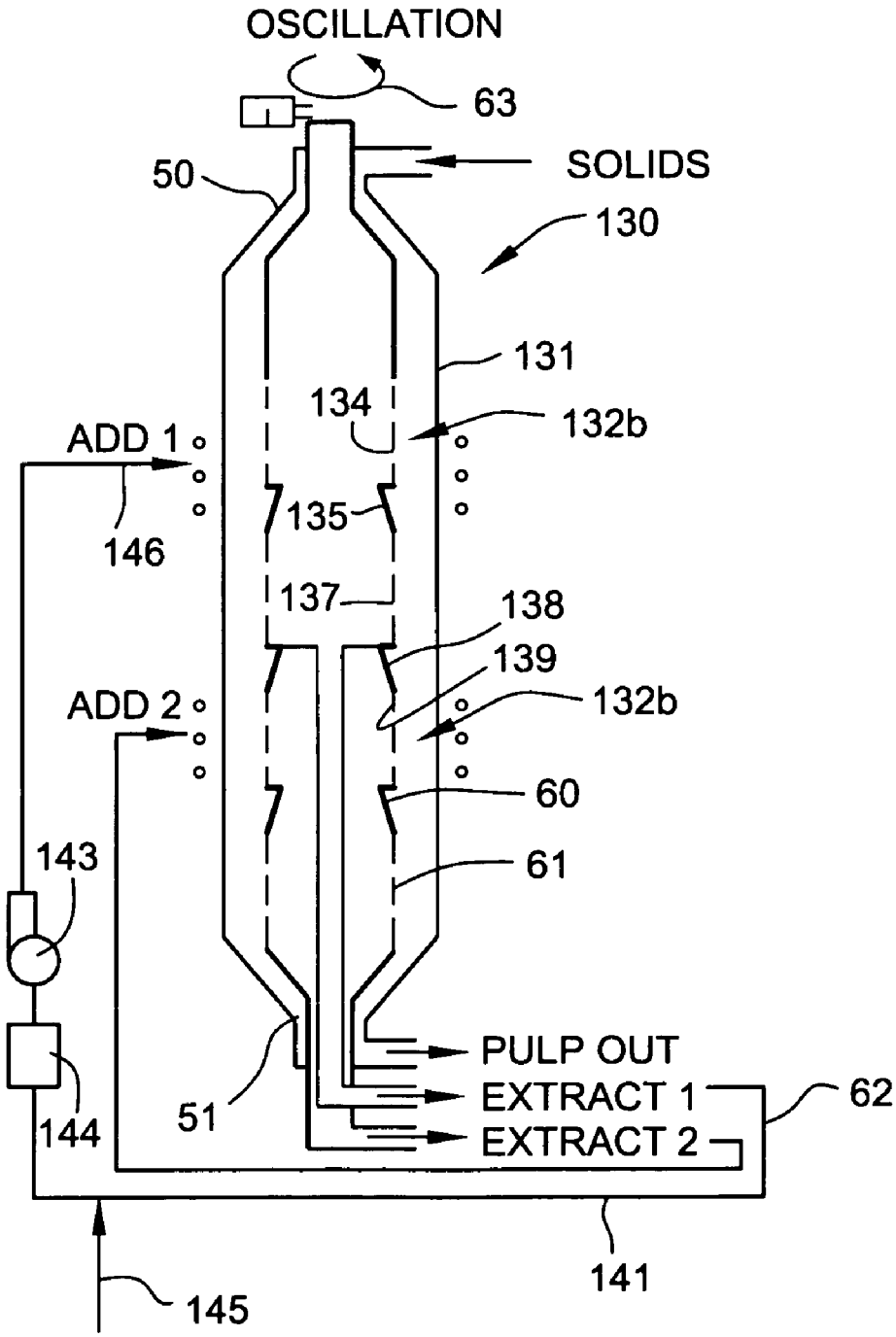
FIG. 4 is a longitudinal schematic cross-sectional view of an exemplary form of another digester according to the invention, having interior substantially stationary screen surfaces.

FIG. 4 is an illustration similar to that of FIGS. 3A and 3C of another embodiment of vessel (e. g. continuous digester) 130 according to the invention. In FIG. 4 all components comparable to those of FIGS. 3A and 3C are shown by the same reference numeral only preceded by a "1", and also the top 50 and bottom 51 of the vessel 130 are illustrated (they are cut off in FIG. 3A).

The main difference between the FIG. 4 and FIGS. 3A and 3C embodiments are the screens 132*b* in FIG. 4 are located substantially at the center of the vessel 130, radially inwardly of the vessel wall 131, so that the slurry flows downwardly radially outwardly of the screens 132*b*, and thus the recirculated liquids are introduced at the wall 131 (e. g. in an annular volume), rather than at the center of the vessel 130. Also, in this embodiment additional screen parts 60, 61 are illustrated, and a second extraction 62 is provided from parts of the screen. Also, while the screws 132*b* are substantially vertically stationary, they may be oscillated or rotated (as indicated schematically by arrow 63) to facilitate cleaning.

While the invention has been herein shown and described in what is presently conceived to be a preferred form thereof, it is to be understood that many modifications may be made thereof within the scope of the invention. That is, the invention is to be interpreted with the broadest scope of the appended claims so as to encompass all equivalent structures and methods.

What is claimed is:

1. A substantially upright vessel for treating or producing cellulose pulp, comprising:

a vessel wall defining a substantially hollow interior, and having atop and bottom;

at least one screen having a screen surface with at least first and second parts, said first part above said second part and substantially immediately adjacent thereto;

said first part being perforated, allowing the passage of extracted liquid therethrough, and defining a first cross-sectional area pathway for slurry flowing therepast;

said second part being substantially solid and having a step-out substantially immediately adjacent said first part, so that said second part step-out defines a second cross-sectional area pathway greater than said first pathway;

a slurry inlet adjacent said vessel wall top; and a slurry outlet adjacent said vessel wall bottom.

2. A vessel as recited in claim 1 further comprising a third perforated part of said screen surface substantially immediately adjacent and below said second part, and a fourth substantially solid part of said screen surface substantially immediately adjacent and below said third part and having a step-out.

3. A vessel as recited in claim 2 further comprising a perforated fifth part of said screen surface substantially immediately adjacent and below said fourth part; and wherein said screen is substantially stationary.

4. A vessel as recited in claim 1 wherein said screen surface is at or adjacent said vessel wall and substantially stationary, and defines a flow path of slurry radially inwardly thereof.

5. A vessel as recited in claim 1 wherein said screen surface is radially interior of said vessel wall, and defines a flow path of slurry radially outwardly thereof.

6. A vessel as recited in claim 3 wherein said second, fourth, and sixth parts each have a portion angling inwardly below said respective step-outs.

* * * * *